US009694298B2

(12) United States Patent
Cheung

(10) Patent No.: US 9,694,298 B2
(45) **Date of Patent: *Jul. 4, 2017**

(54) TOY CONSTRUCTION KITS

(71) Applicant: Huntar Company, Union City, CA (US)

(72) Inventor: Jason Cheung, Union City, CA (US)

(73) Assignee: HUNTAR COMPANY, INC, Union City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/999,201

(22) Filed: Apr. 11, 2016

(65) Prior Publication Data

US 2016/0310864 A1 Oct. 27, 2016

Related U.S. Application Data

(63) Continuation-in-part of application No. 14/120,799, filed on Jun. 30, 2014, now Pat. No. 9,308,465.

(51) Int. Cl.

| | |
|---|---|
| ***A63H 33/08*** | (2006.01) |
| ***A63H 33/06*** | (2006.01) |
| ***A63H 33/04*** | (2006.01) |
| ***A63H 3/04*** | (2006.01) |
| ***A63H 3/16*** | (2006.01) |

(52) U.S. Cl.

CPC ..... *A63H 33/084* (2013.01); *A63H 3/04* (2013.01); *A63H 3/16* (2013.01); *A63H 33/044* (2013.01); *A63H 33/046* (2013.01); *A63H 33/065* (2013.01); *A63H 33/08* (2013.01)

(58) Field of Classification Search

USPC ..... 446/85, 93, 95, 106, 107, 108, 109, 118

See application file for complete search history.

(56) References Cited

U.S. PATENT DOCUMENTS

| | | | | | |
|---|---|---|---|---|---|
| 2,693,663 | A | * | 11/1954 | Burchard | A63H 33/04 403/346 |
| 2,710,488 | A | * | 6/1955 | Schaper | A63H 33/04 446/106 |
| 2,883,764 | A | * | 4/1959 | Stephens | G09B 25/04 220/4.28 |
| 3,605,323 | A | * | 9/1971 | Fischer | A63H 33/103 446/102 |
| 3,918,196 | A | * | 11/1975 | Schleich | A63H 33/04 428/16 |
| 4,527,981 | A | * | 7/1985 | Chisum | G09B 25/04 434/72 |
| 5,064,399 | A | * | 11/1991 | Klitsner | A63H 33/08 446/118 |
| 5,199,919 | A | * | 4/1993 | Glickman | A63H 33/062 446/120 |
| 5,875,792 | A | * | 3/1999 | Campbell, Jr. | A45D 2/18 132/246 |

(Continued)

*Primary Examiner* — Kurt Fernstrom

(74) *Attorney, Agent, or Firm* — Jonathan E. Grant; Grant Patent Services

(57) ABSTRACT

A toy construction kit is disclosed. The construction kit comprising a plurality of flexible construction pieces, each of said flexible construction pieces comprising bendable rod made up of a metal wire with a plastic surrounding the metal wire. In one embodiment, the plastic wire is flexible, said plastic surrounding said metal wire forming an elongated structure. Disks are spaced along the length of rod.

27 Claims, 15 Drawing Sheets

(56) References Cited

U.S. PATENT DOCUMENTS

| | | | | |
|---|---|---|---|---|
| 5,916,006 | A * | 6/1999 | Ganson | A63H 33/00 446/107 |
| 6,220,919 | B1 * | 4/2001 | Cheng | A63F 9/12 273/153 P |
| 6,402,581 | B1 * | 6/2002 | Podgaiz | A63H 33/04 403/174 |
| 8,870,185 | B2 * | 10/2014 | Cheng | A63F 3/00574 273/276 |
| 8,961,257 | B2 * | 2/2015 | Connor | A63H 33/065 446/107 |
| 2006/0025034 | A1 * | 2/2006 | Slocum | A63H 33/065 446/119 |
| 2011/0081824 | A1 * | 4/2011 | Heston | A63H 33/044 446/86 |

* cited by examiner

TOY CONSTRUCTION KITS

This application is a continuation-in-part of U.S. patent application Ser. No. 14/120,799, filed Jun. 30, 2014, herein incorporated in its entirety by reference.

Over the years, there have been a number of different toy construction kits. Most involve parts which are rigid. A few toys have parts which connect the rigid parts.

The present disclosure is for a construction kit wherein the individual construction pieces can be assembled in such a way that the construction pieces interlock. Such an arrangement allows for the pieces to be stackable. When the pieces are stacked, they can be locked together to secure the design into which the pieces are stacked.

The present disclosure will become more apparent upon reading of the following non-restrictive description thereof, given for the purpose of exemplification only, with reference to the accompanying drawings.

DETAILED DESCRIPTION OF THE DISCLOSURE

Figure 1:
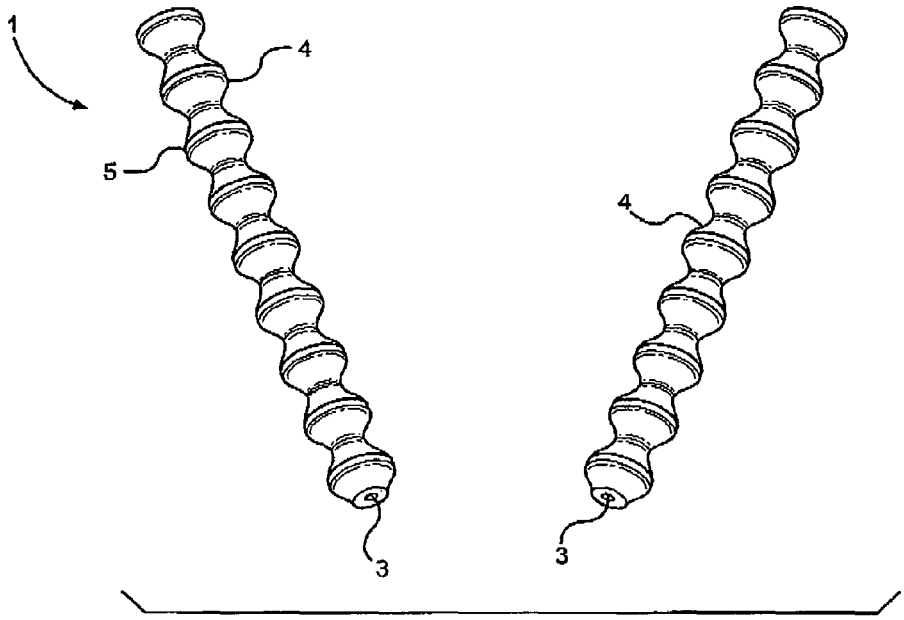
FIG. 1 is a cutaway side view of the construction piece.
Figure 2:
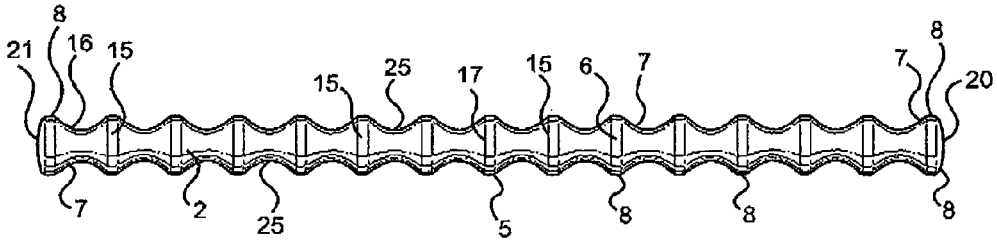
FIG. 2 is a perspective view of the construction piece.
Figure 3:
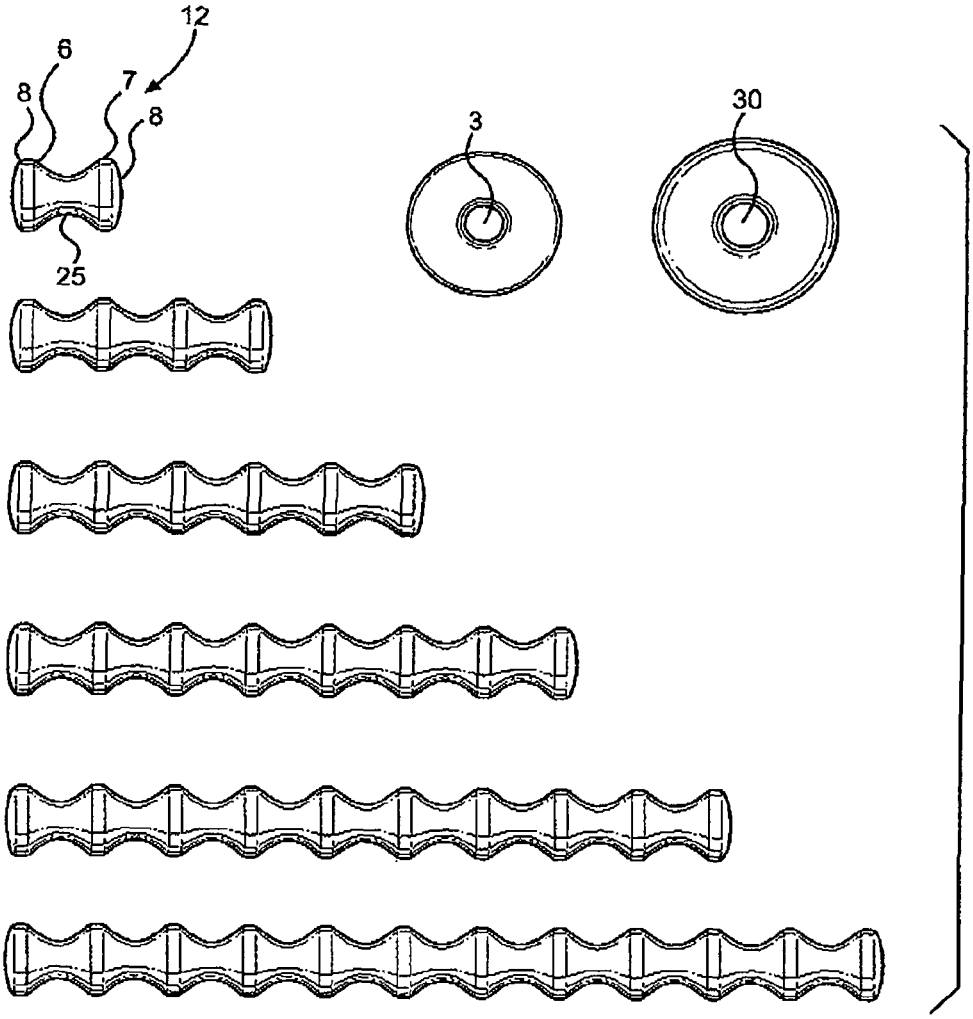
FIG. 3 is a frontal view of some of the different sizes of the construction pieces, including the wheels.
Figure 4:
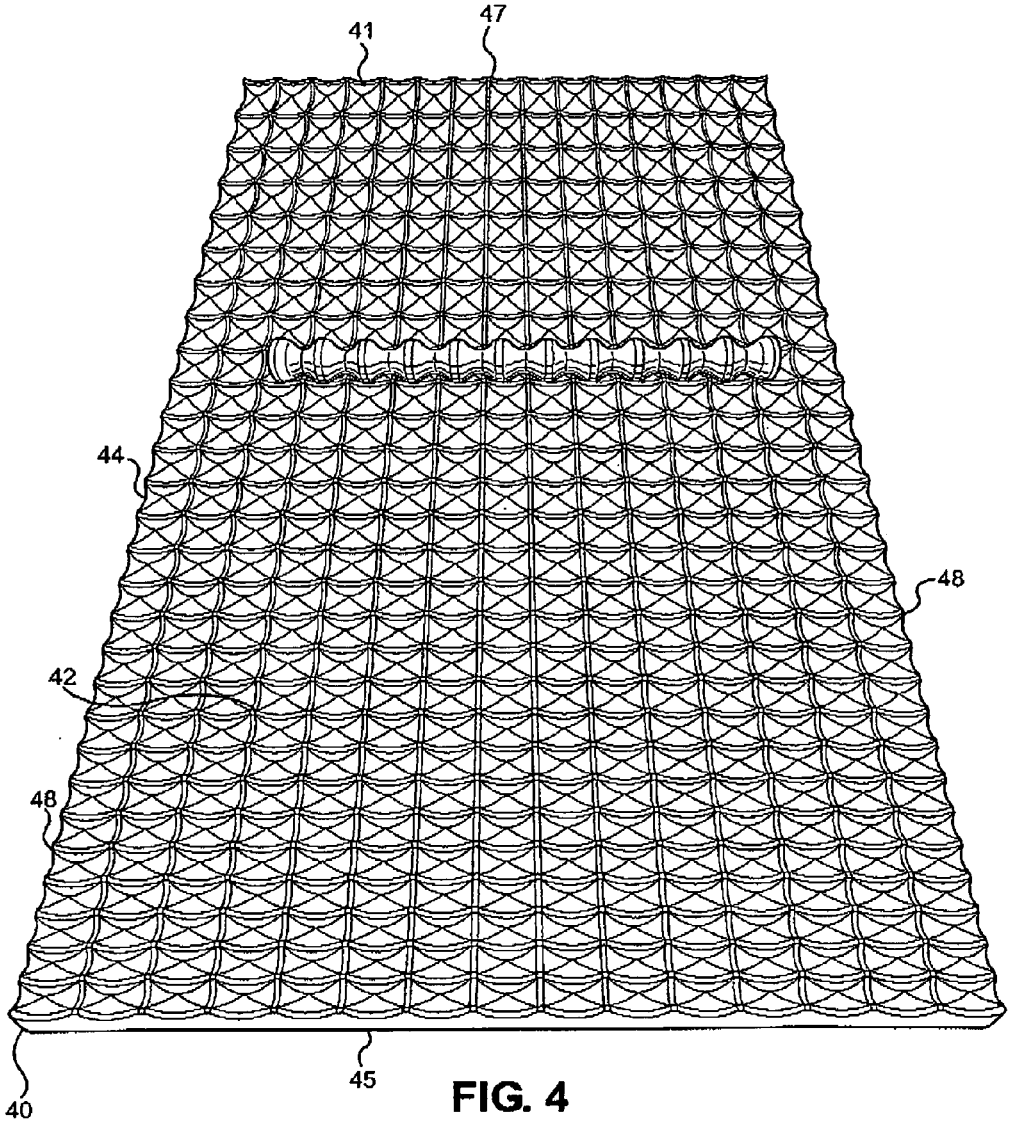
FIG. 4 is a top view of a platform.
Figure 5:
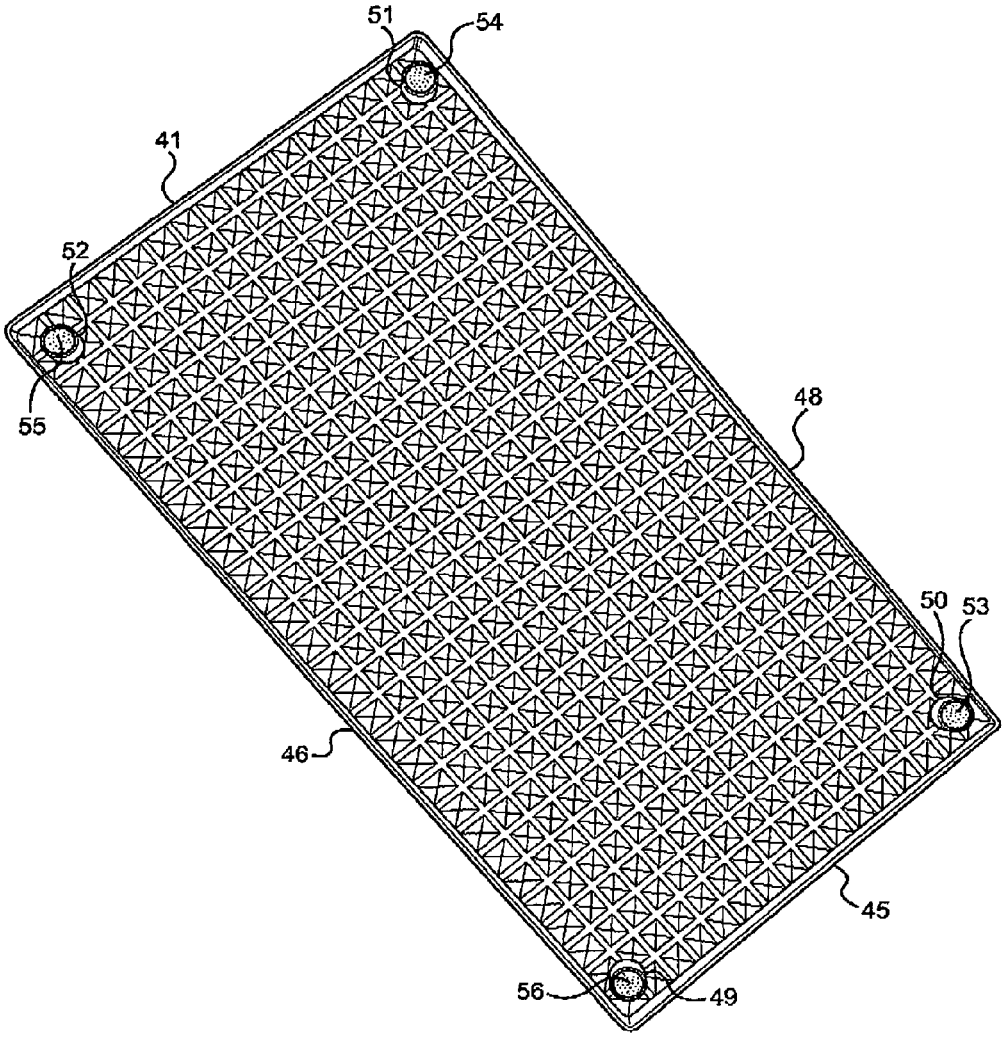
FIG. 5 is a bottom view of the platform.
Figure 6A:
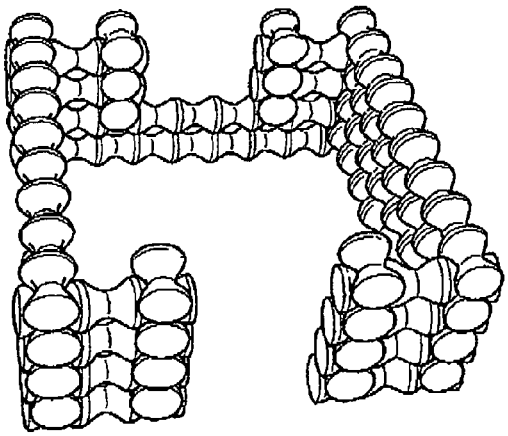
FIG. 6A is a perspective view of construction of a log cabin.
Figure 6B:
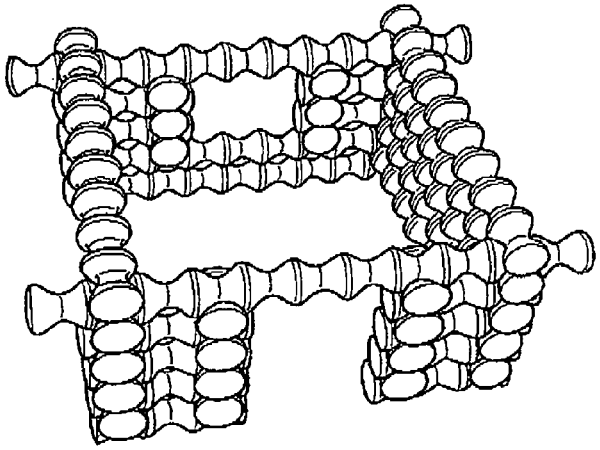
FIG. 6B is a perspective view of the addition of cross-beams of a log cabin.
Figure 6C:
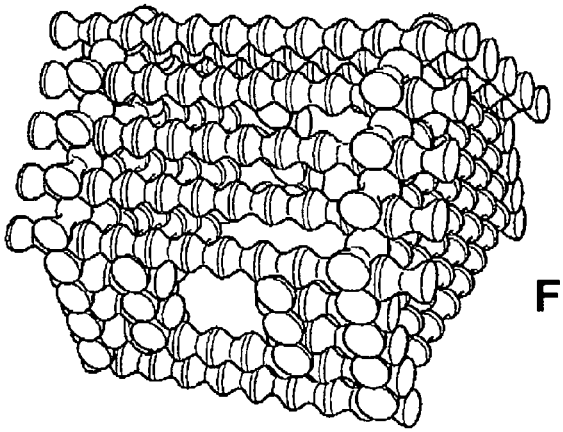
FIG. 6C is a rear perspective of a window of a completed log cabin.
Figure 6D:
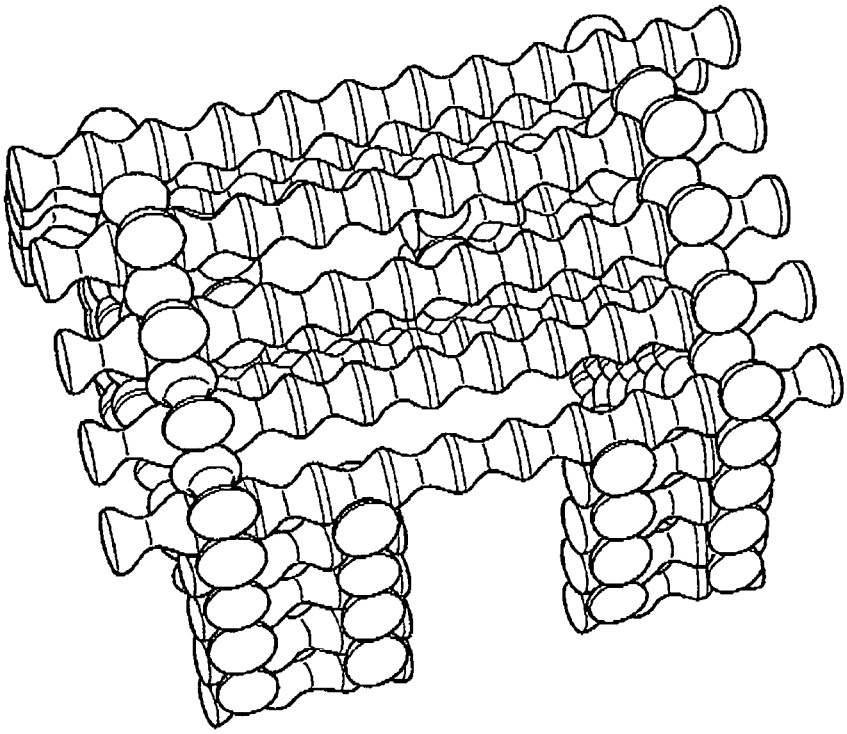
FIG. 6D is a perspective view of the front of the completed log cabin.
Figure 6E:
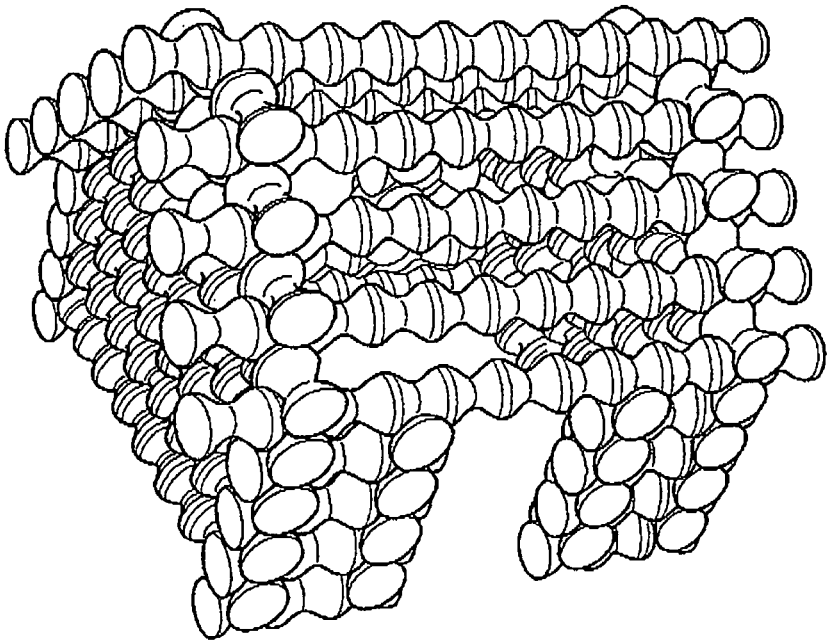
FIG. 6E is a perspective view showing the side of the completed log cabin.
Figure 7:
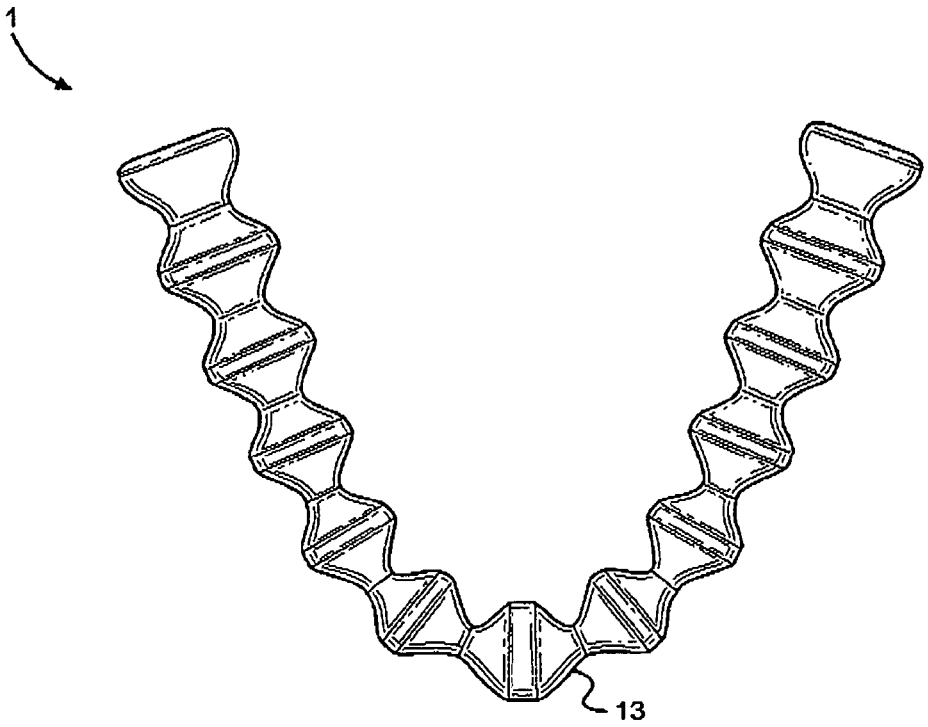
FIG. 7 is a perspective view of one of the rods that has been bent.
Figure 8A:
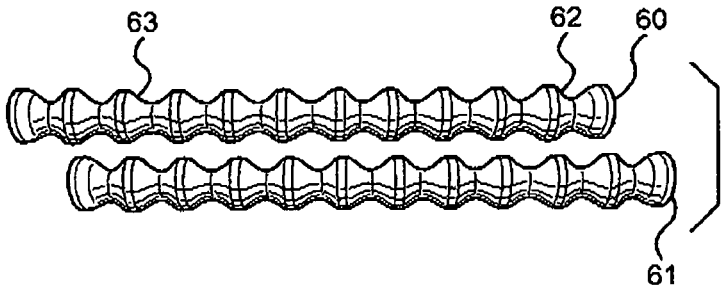
FIG. 8A—is a frontal view of the two parallel 11 disk rods for the first step of building a race car.
Figure 8B:
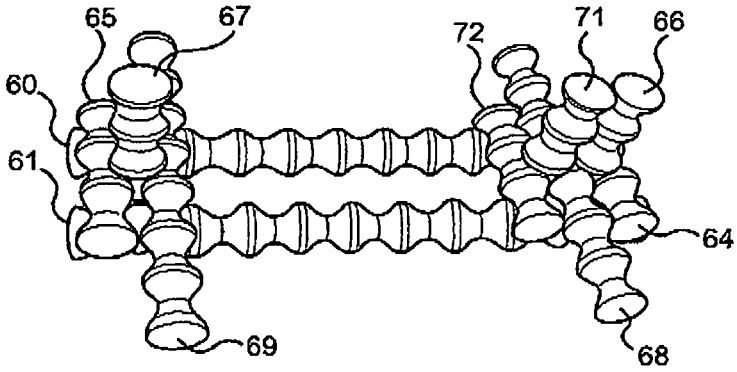
FIG. 8B—is a perspective view of the second step of building the race car.
Figure 8C:
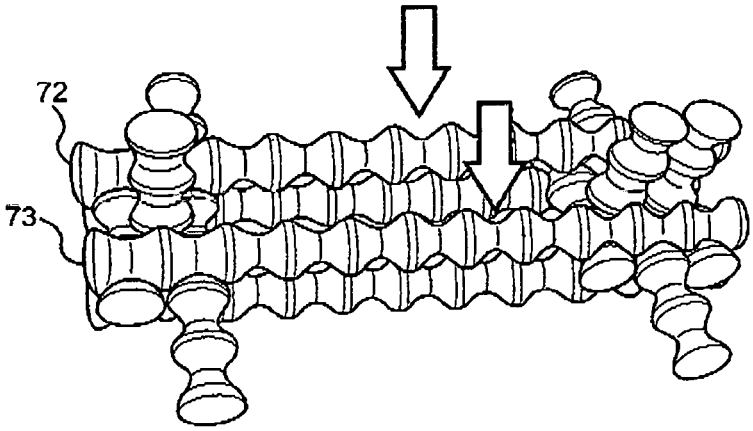
FIG. 8C—is a perspective view of the third step of the building the race car.
Figure 8D:
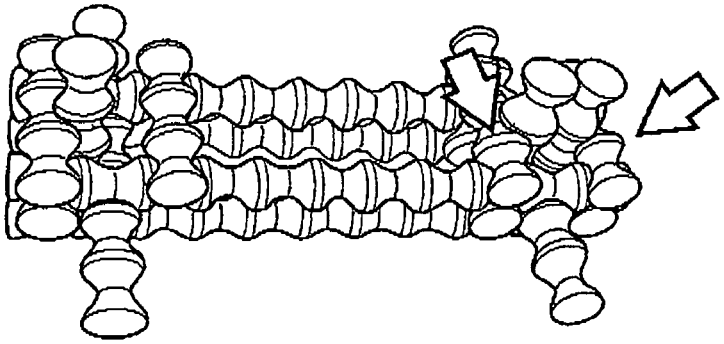
FIG. 8D—is a perspective view of the fourth step of the building the race car.
Figure 8E:
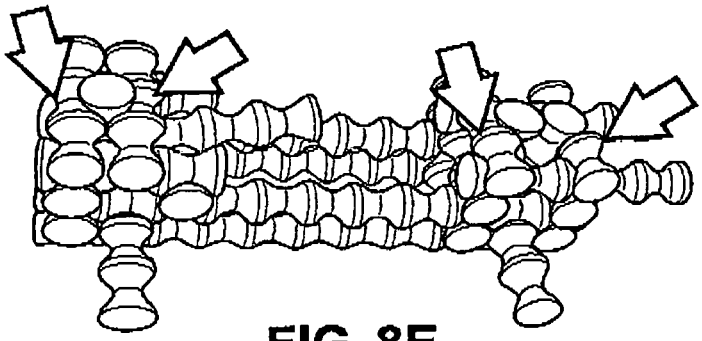
FIG. 8E—is a perspective view of the fifth step of the building the race car.
Figure 8F:
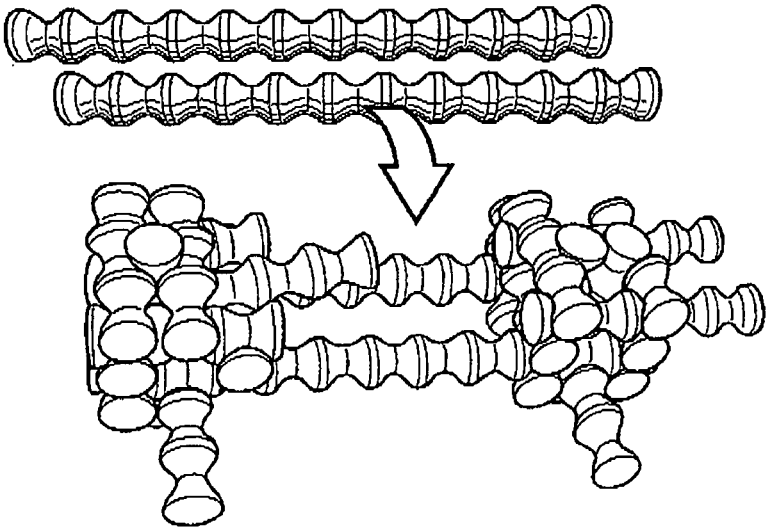
FIG. 8F—is a perspective view of the sixth step of the building the race car.
Figure 8G:
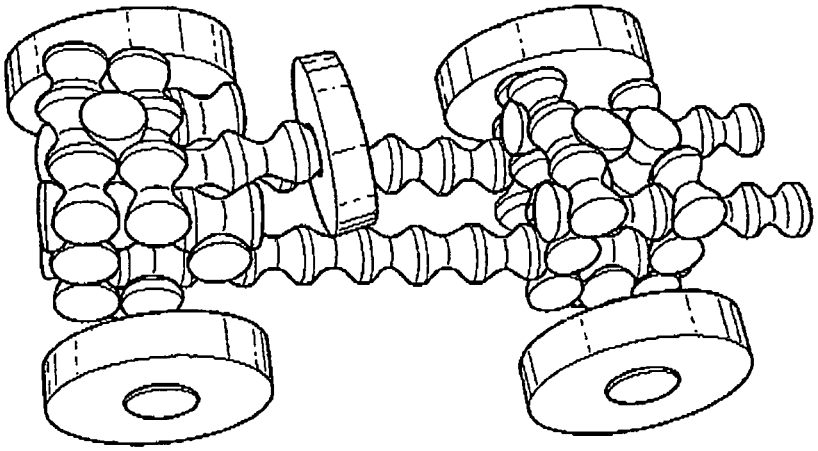
FIG. 8G is a perspective view of the final race car using the snap and lock feature.
Figure 9:
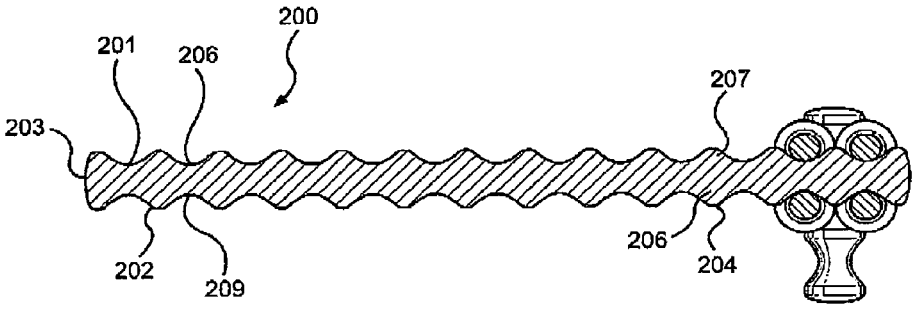
FIG. 9 is a cross sectional view showing the angles and dimensions of the construction piece.

The construction kit 1 includes a plurality of construction rods 2. The construction rods are elongated rounded sticks, having disks 5 positioned along the length of the construction piece. Each disk 5 is comprised of two identically shaped conically shaped half disks 6,7, each half disk sharing a common rim 8. Each half disk 6,7, has a base 16, with the base 16 being smaller than the rim 8. Depending on one's perspective, the base either tapers upwards towards the rim 8, or tapers away from the rim 8. There is also a side 17 surrounding and between the circumference 18 of the rim and a circumference 19 of the base. Between the disks are curvatures 25. The construction rods are comprised of either plastic or rubber. The disks 5 are part of an integrally molded with the rod 2.

All of the disks 5 on a single construction rod 2 are of the same diameter and size, with the disks to the rod ratio ranging from about: 3.5:1 to about 4.5:1. In another embodiment, the ratio is 4:1. The distance between the disks ranges from 10-14 mm.

Each end of the rods 2 terminates in a half disk 6,7, with the rim 8 of each of the half ridge 6,7 facing outward. In one embodiment, the outside ends 20, 21 of each of the half ridges 2 are rounded or slightly curved. The rods 2 are made by means of an extrusion molding process known in the industry. In one embodiment of the disclosure, there are molding holes 15 periodically in the rounded stick 9.

In one embodiment, the kit comprises construction pieces of different lengths based on the number of disks 5 present. The smallest construction piece 12 has merely two half disks 6,7 the bases 8 of which face inward. Between every two disks or half disks is a groove 25. The length of the smallest piece can range from about 14.-14.4 mm. In one embodiment, the length is 14.28 mm. The larger of the construction piece 13 can have 10-15 or more disks 5.

More specifically, the number of and different lengths of the rods in the kit varies. For example, in one kit, there can be:

0>30 one groove rods
0>30 two groove roads
0>30 three groove rods
0>30 four groove rods
0>30 five groove rods
0>30 six groove rods
0>30 seven groove rods
0>30 eight groove rods
0>30 nine groove rods
0→30 ten groove rods
0>30 eleven groove rods
Etc.

In another embodiment, the different length construction rods 2 are of different colors. Colors that are used include but are not limited to yellow, orange purple, blue, red, and green. Alternatively, the rods can be translucent with color, or they can be completely transparent with a tint of color, or no color.

In one embodiment, the construction rods interlock. This is accomplished by the proper sizing and positioning of the various parts of the construction rod. In one embodiment, the angle of the curvature 200 of the groove between disks is 107 degrees. The radius of the curvature 201 is 4.00 mm. The curvature of the peak 202 of the disk is 0.30 mm, and the curvature of the end section 203 of the construction rod has a radius of 15.6 mm. Measuring along the Y axis, the width of the construction rod from the top of one rim 204 on a disk 206 to the opposite peak 205 on an opposite disk 207 is 12.2 mm. Measuring along the Y axis, the width from the bottom of one curvature 208 to the bottom of another curvature 209 is 6.10 mm. Of course, the construction kit can have pieces that are larger or smaller than that which is indicated in the figures, supra. Even if the pieces are several times larger than the figures given above, the ratio(s) of the various measurements remain(s) the same.

Figure 10:
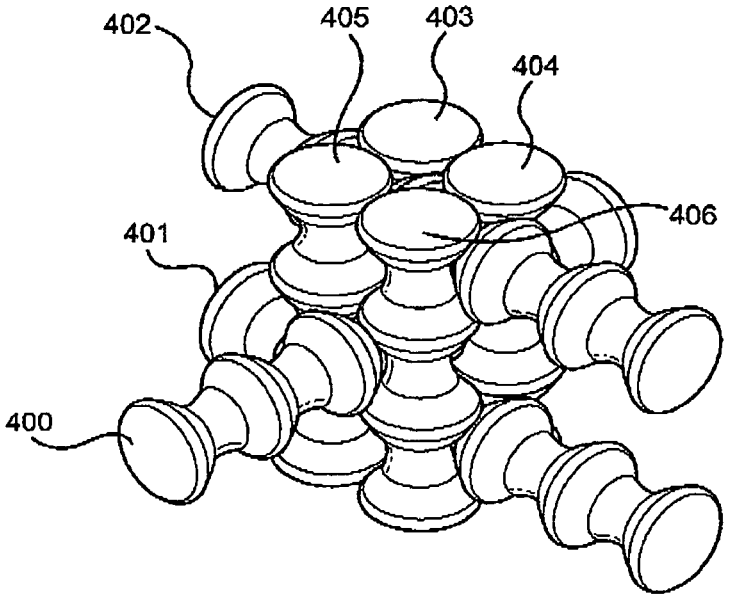
FIG. 10 is a perspective view of an assemblage of construction rods "locked" together.
Figure 11:
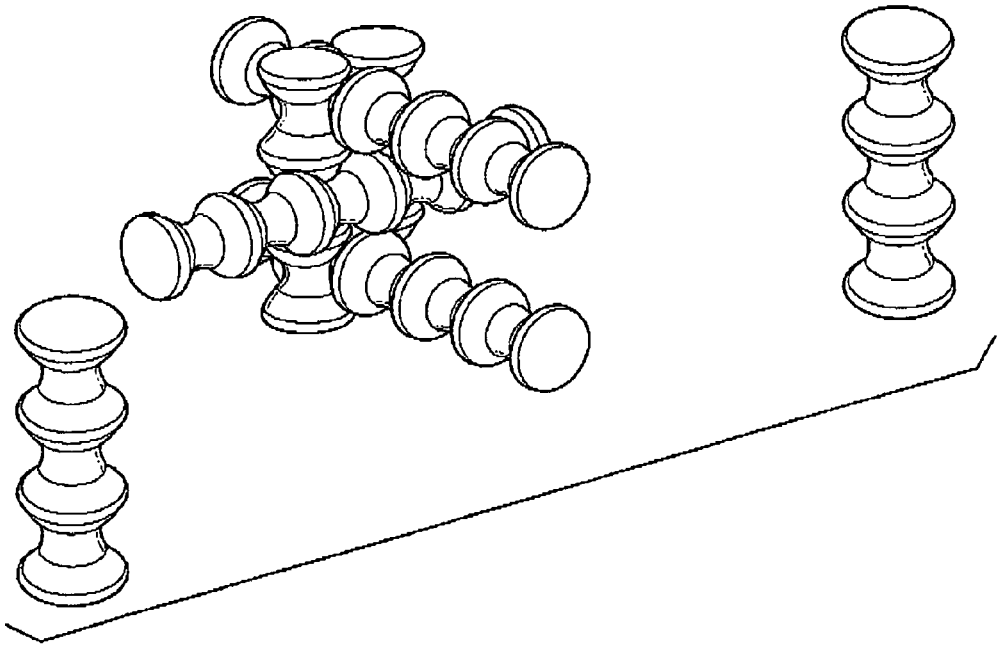
FIG. 11 is an exploded view of the construction rods in FIG. 10.
Figure 12:
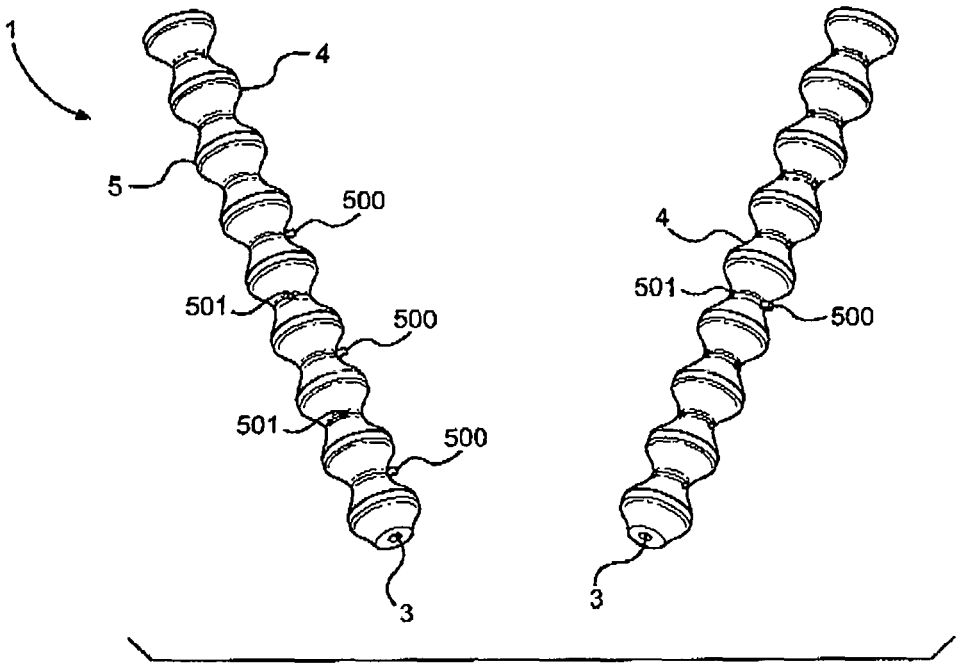
FIG. 12 is an alternative embodiment of the kit.
Figure 13:
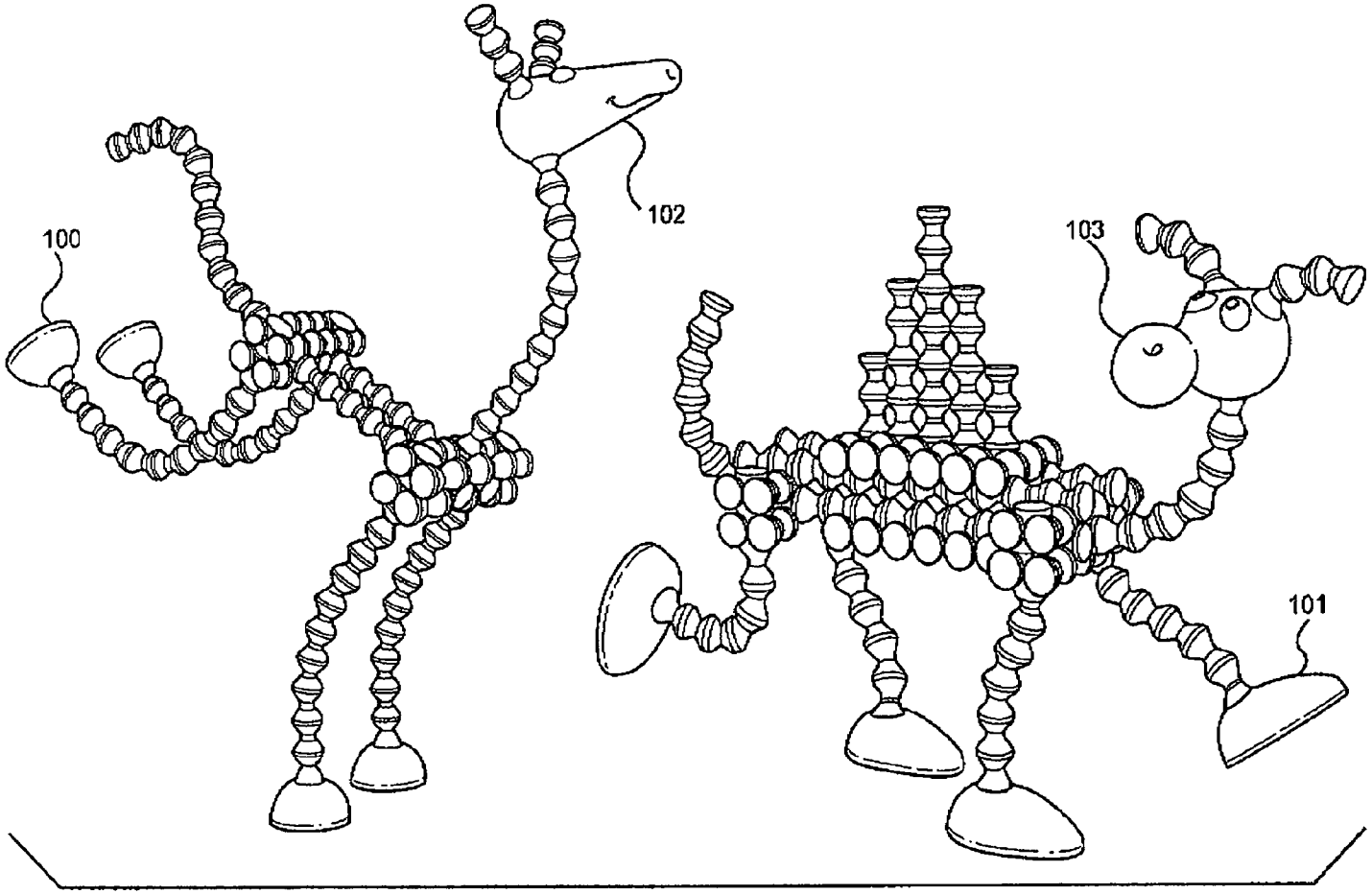
FIG. 13 is a perspective view on optional parts.

As shown in FIG. 10, the best method of "connecting" or "locking" the construction rods together is to have the pieces connected along the x, y, and z axis. As shown in the figure, a construction rod 400 in the z position is bound by two construction rods 401, 402 in the x position, and construction rods 400, 401, and 402 are bound by construction rods 403, 404, 405, 406 in the y position. An exploded view of this assembly is shown in FIG. 11. The interconnection of the various parts puts pressure on each of the parts, and in particular on the disks, which in turn secures the various construction pieces in place.

In another one version or example of the construction kit, the construction rod 1 is flexible. When the rod is flexible, the construction rod 1 is made of a flexible wire 3 encased in plastic 4. More specifically, the center of the length of the construction rod 2 is a flexible wire 3. In one embodiment, the wire 3 is made out of stainless steel. In another embodiment, the wire 3 is made out of copper. In other embodiments the wire is made out of chrome, steel, aluminum, alloys, or other metal wires. In one embodiment, the metal wire resists oxidation. The wire 3 is from about 1.0 mm to about 2.5 mm thick. In another embodiment, the wire is from about 1.0 to 2.0 mm thick, and in another embodiment, the wire is 1.5 mm thick The wire 3 runs from about half to the full length of the rod 2. In relation to the widget of the wire, the rod is from about 20 to 30 mm thick. In another embodiment, the rod is from about 25 to 30 mm thick, and in another embodiment, the rod is 28 mm thick. Fundamentally, the rod width to wire thickness is about 18:1 to 20:1. Note that the width and length of the rod can vary, and as such, the dimensions of the wire will vary in the ratios given. In an alternative embodiment, a "large" version of this toy construction kit has the same ratios, only with much larger dimensions.

The plastic 4 itself is a durable plastic that accepts any plastic extrusion colorant prior to the extrusion process. In one embodiment, the plastic 4 is ethylene-vinyl acetate. In another embodiment, the plastic 4 is high impact polystyrene, and in yet another embodiment the plastic is acrylonitrile butadiene styrene. The plastic 4 is any durable plastic that can be bent without tearing or breaking. The wire 3 encased in the plastic allows the plastic to be bent without memory issues. In another embodiment of the disclosure, the construction rods are also magnetic. In the non-bendable rods, a magnetic rod is molded within the plastic rod, being molded by means of an extrusion process. The magnet can be made out of any of the magnetic elements, alloys, and minerals, including ferromagnetic materials such as iron, nickel, cobal talloys of rare earth metals, and some naturally occurring minerals such as lodestone. Other materials that can be used include: Alni, Alcomax, Hycomax, Columax, and Ticonal, as well as samarium-cobalt and neodymium-iron-boron (NIB) magnets.

In another embodiment, the bendable construction rods also contain a magnetic wire or force encased within the plastic. In one embodiment, the magnetic wire is thicker than a non-magnetic version of the construction rod, while still being bendable. In another embodiment, small magnetic elements are embedded within the plastic during the extrusion process. In yet another embodiment, the wire running through the plastic is made of a very powerful magnetic material.

In another embodiment, the construction rods 2 are not bendable. In one embodiment, these construction rods still have the property to be "interlockable" with other construction rods. In another embodiment, these construction rods are magnetic. In another embodiment, the non-bendable construction rods 2 have all of the features of the bendable rods, except that they are not bendable.

In an alternative embodiment, the rods can be held together a series of small pegs 500 and holes 501 that are used to secure each of the construction rods together. Both the pegs 500 and the holes 501 are positioned in the curvatures between the disks. One side of the rods contain the pegs 500 while the holes 501 are positioned either 90 degrees and/or 180 degrees rotation on the rod. In one embodiment, there are one row of holes 501 on one side of the construction rods 2 and 180 degrees on the other side are the pegs 500. Alternatively, there can be alternating rows of pegs 500 and holes 501. The pegs 500 are integral with the plastic or rubber of the construction rod. In one embodiment, the holes 501 and pegs 500 are used instead of magnets or other forms of attachments.

In yet another embodiment, the holes and pegs are used with other embodiments.

In one embodiment, the kit also includes tires 30. The tires can be of any size. In one embodiment, there are a set of these tires 30 can range in size from 1" in diameter to 4" or more in diameter. In another embodiment, the tires are from about ¾" to 3" or more. In yet another embodiment, the tires are from about 1" to about 2" in diameter. The tires 30 are made out of a material that is selected from the group consisting of rubber, foamed rubber, and flexible plastics. In one embodiment, the tires are made out of ethylene vinyl acetate. In another embodiment, the tires are made of cardboard. The tires have a small hole 33 in the middle of the flat surface of the tire 30, from about ¼" to about ⅜" in diameter. This hole 33 stretches to fit over the first disk (or half disk) at each end of the rod 2.

In yet another embodiment, the construction kit includes hooves 100, 101 and heads 102, 103 of animals. These parts allow children to make animals or dinosaur type structures with the construction kit.

The kit also comes with a mat 40. In one embodiment, the plastic is comprised of a rigid plastic, semi-rigid plastic, rubber, metal, or wood. In another embodiment, the plastic is ABS plastic. The mat can be a variety of shapes. In one embodiment, the mat 40 is rectangularly shaped. In another embodiment, the mat is square, rounded, oval, a hexagon, a pentagon, a septagon, an octagon, or any other geometric shape. In another embodiment, the mat is amorphous shaped. The surface 41 of the mat 40 is waffled. More particularly, the surface 41 comprises a plurality of rectangular wells 42 formed by a plurality of intersecting walls 42,43. The wells 42 are large enough and spaced such that the disks 5 of the rods 2 mate with a row 44 of wells 42.

In one embodiment, the surface 41 of the mat 40 has four sides 45, 46, 47, and 48. On the underside of each corner of the surface 41 are legs 49, 50, 51, and 52, which in one embodiment have rubber tips 53, 54, 55, and 56.

Referring to FIGS. 6*a*-6*d*, it is easy to intermix the different sized rods or construction pieces together. FIGS. 7*a*-7*e* show the construction of a "log cabin," using the intersection of different sized rods.

In another embodiment, the tire is fitted over and into a groove (FIG. 8).

In another embodiment of the disclosure the design of the disclosure, the kit has a snap and lock feature which locks and holds the pieces in a fixed position allowing a user to lift and play with the item that was constructed. The FIGS. 9*a*-9*f* show the steps of the construction for a race car using the snap and lock feature.

Specifically, the first step is to position two eleven groove rods 60, 61 parallel to each other. At each end 62, 63 a three groove rod 64, 65 is laid cross sectionally on top of and across the two eleven groove roads. At each end another three groove rod 66, 67 is positioned perpendicularly on the inside of the rods 64, 65. At each end, seven piece groove piece 68, 69 is positioned equilaterally in front of the perpendicular three groove rod 66, 67. At one end 62, another three groove rod 71 is positioned perpendicularly to said groove rod 69 and parallel to said three groove rod. That in turn is secured in place by a three grooved part 72 in front of and parallel and in contact with seven piece groove piece 69. Next, parallel eleven groove rods 72, 73 are placed on top of an in parallel with rods 60, 61.

The rest of the drawings show the progression of how the pieces are secured together.

It is to be understood that even though numerous characteristics and advantages of the present embodiments have been set forth in the foregoing description with details of the structures and functions of the embodiments, the disclosure is illustrative only, and changes made in detail, especially in matters of shape, size, and arrangement of parts, within the principles of the embodiments, to the full extent indicated by the broad general meaning of the terms in which the appended claims are expressed.

What is claimed is:

1. A toy construction kit, said toy construction kit comprising a plurality of construction pieces, each of said construction pieces comprising:

a) A rod comprising:

i) at least two half disks integral with and positioned perpendicularly to said rod, each of said half disks comprising:

I) a rim;

II) a base, said base smaller than said rim; and

III) a side surrounding and between the circumference of the rim and a circumference of the base;

said one said half disk being positioned at each end of said rod, said rim of each said half disk facing outward from said rod, said rod and said half disks being integrally molded;

said plurality of construction pieces being of varying lengths and being comprised of a material selected from the group consisting of plastic and rubber, further including a plurality of rods of different lengths, said plurality of rods comprising:

iii) at least one disk, said disk comprised of two said half disks, each said half disk positioned perpendicularly to an axis of said rod, wherein said two half disks are integrally molded together at their rim, said disk positioned between said half disks at each end of the rod, said disks being integrally molded as part of the rod;

b) a plurality of said disks positioned between said half disks at each end of the rod, said disks being the same equidistance from each other and from the half disks, such that the number of disks on said rod are dependent on a length of said rod;

wherein said construction pieces interlock with other said construction pieces.

2. The toy construction kit of claim 1, wherein said construction pieces are flexible.

3. The toy construction kit of claim 1, wherein each of said construction pieces further comprises a flexible wire around which said plastic of each of said construction pieces is extruded.

4. The toy construction kit of claim 3, wherein said flexible wire is comprised of a magnetic material.

5. The toy construction kit of claim 1, wherein said construction pieces are comprised of plastic.

6. They toy construction kit of claim 3, wherein said plastic of each of said construction pieces is extruded around said flexible wire.

7. The toy construction kit of claim 6, wherein said flexible wire is a metal wire.

8. The toy construction kit of claim 1, further comprising a groove positioned between two half disks, wherein an angle of a curvature of said groove between said half disks is 107 degrees.

9. The toy construction kit of claim 8, wherein said groove between said two half disks has a curvature radius of 4.00 mm.

10. The toy construction kit of claim 1, further comprising a peak at a crest of each disk, wherein each said peak of each said disk has a curvature of 0.30 mm radius.

11. The toy construction kit of claim 10, wherein a Y cross sectional measurement from the peak one disk to the peak of an opposite and opposing disk is 12.20 mm.

12. The toy construction kit of claim 1, wherein a Y cross sectional diameter of the disk from measured from a nadir point in the groove to a zenith point of the disk is 6.10 mm.

13. The toy construction kit of claim 12, wherein the ratio of the Y cross-sectional diameter of a measure of the distance from said peak of said disk to said peak of a next closest said disk divided by the measure of the distance from the radar point of said groove to said nadir point the next closest groove is 2.0.

14. The toy construction kit of claim 1, wherein said each of said half disks being positioned at each end of said rod, said rim of each said half disk facing outward from said rod, said rim of said each said half disk having a curvature radius of 15.6 mm.

15. The toy construction kit of claim 10, wherein a ratio of the radius of the peak to the radius of the curvature is 0.075.

16. The toy construction kit of claim 7, wherein a metal of said metal wire is selected from the group consisting of copper, stainless steel, steel, aluminum, and alloys.

17. The toy construction kit of claim 16, said metal wire consisting of stainless steel.

18. The toy construction kit of claim 16, where said metal is oxidation resistant.

19. The construction kit of claim 7, wherein said plastic surrounding said metal wire is durable plastic that accepts any plastic extrusion colorant prior to the extrusion process.

20. The construction kit of claim 5, wherein said plastic is selected from the group consisting of ethylene-vinyl acetate, high impact polystyrene, and acrylonitrile butadiene styrene.

21. The construction kit of claim 1, wherein said rods of different lengths are color coded.

22. The toy construction kit of claim 1, where said rods are transparent.

23. The toy construction kit of claim 1, wherein said rods are translucent.

24. The construction kit of claim 1, further comprising tires, said tires comprising a slit or hole in the middle, said tires having the ability to fit over each of said half disks at each end of said rod.

25. The construction kit of claim 1, further comprising a platform base.

26. The construction kit of claim 25, wherein said platform base has a waffled grid surface.

27. The construction kit of claim 1, further comprising:

a) a plurality of pegs on. one side of the plurality of rods; and b) holes positioned either 90 degrees or 180 degrees from the plurality of pegs on the plurality of rods.

* * * * *